United States Patent [19]

Ketner

[11] Patent Number: 4,525,077

[45] Date of Patent: Jun. 25, 1985

[54] TIMEPIECE HAVING CENTRAL OPENING

[76] Inventor: Eugene N. Ketner, P.O. Box 380494, San Antonio, Tex. 78280

[21] Appl. No.: 652,746

[22] Filed: Sep. 19, 1984

Related U.S. Application Data

[63] Continuation-in-part of Ser. No. 337,110, Jan. 5, 1982, Pat. No. 4,473,304.

[51] Int. Cl.[3] ..... G04B 19/20; G04B 37/00

[52] U.S. Cl. ..... 368/77; 368/223; 368/281; 368/285

[58] Field of Search ..... 368/77, 88, 221, 223, 368/220, 232, 233, 276, 281, 284, 297, 298, 299, 300–302

[56] References Cited

U.S. PATENT DOCUMENTS

| | | | |
|---|---|---|---|
| 3,712,046 | 1/1973 | Dill | 368/85 |
| 3,952,499 | 4/1976 | Reisman | 368/276 |
| 3,968,639 | 7/1976 | Bekets et al. | 368/84 |
| 4,253,178 | 2/1981 | Kolaczia | 368/285 |

FOREIGN PATENT DOCUMENTS

| | | | |
|---|---|---|---|
| 53-76073 | 7/1978 | Japan | 368/232 |

*Primary Examiner*—Vit W. Miska

*Attorney, Agent, or Firm*—Marcus L. Bates

[57] ABSTRACT

A time piece such as a pocket or wrist watch having a large central opening formed therethrough which causes the watch to assume a toroidal configuration. Various inserts, made complimentary respective to the central opening, are supported within the central opening. The artistic design placed on either face of the insert admits a large selection of unique and personalized material to be readily available to the individual that wears the watch.

14 Claims, 16 Drawing Figures

FIG. 1
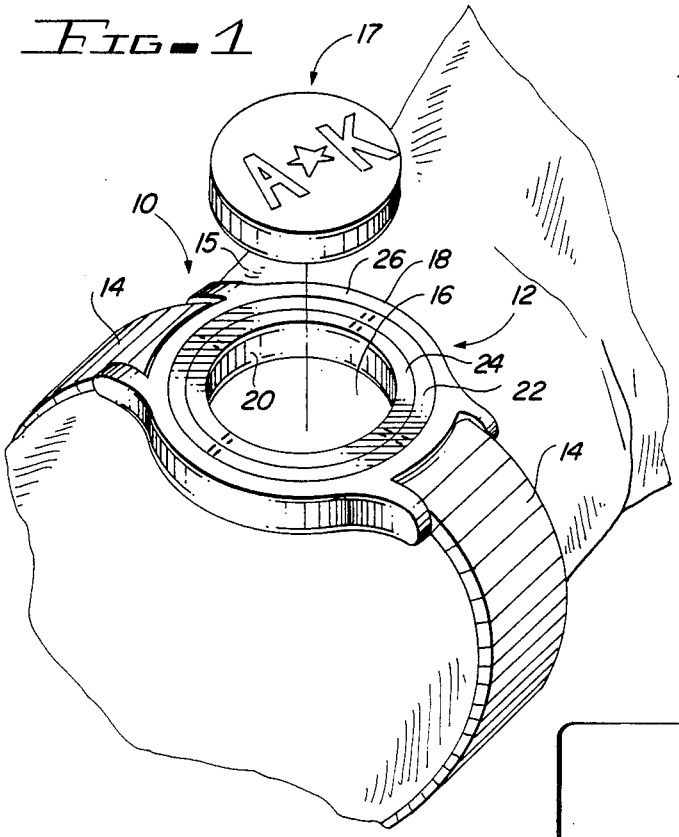
FIG. 2
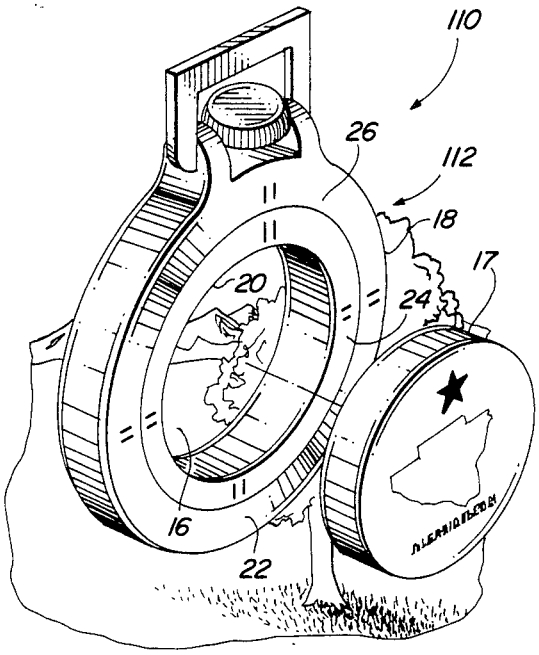
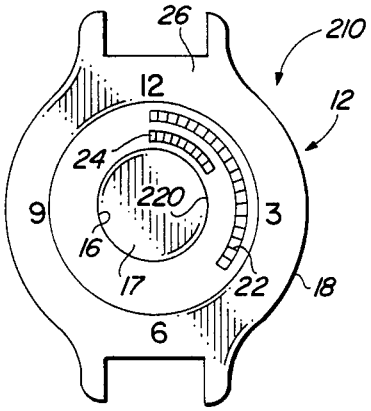
FIG. 3
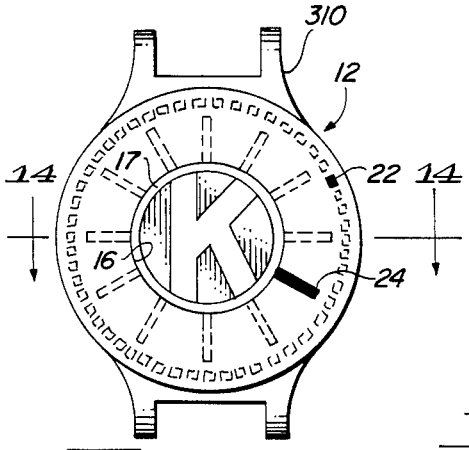
FIG. 4
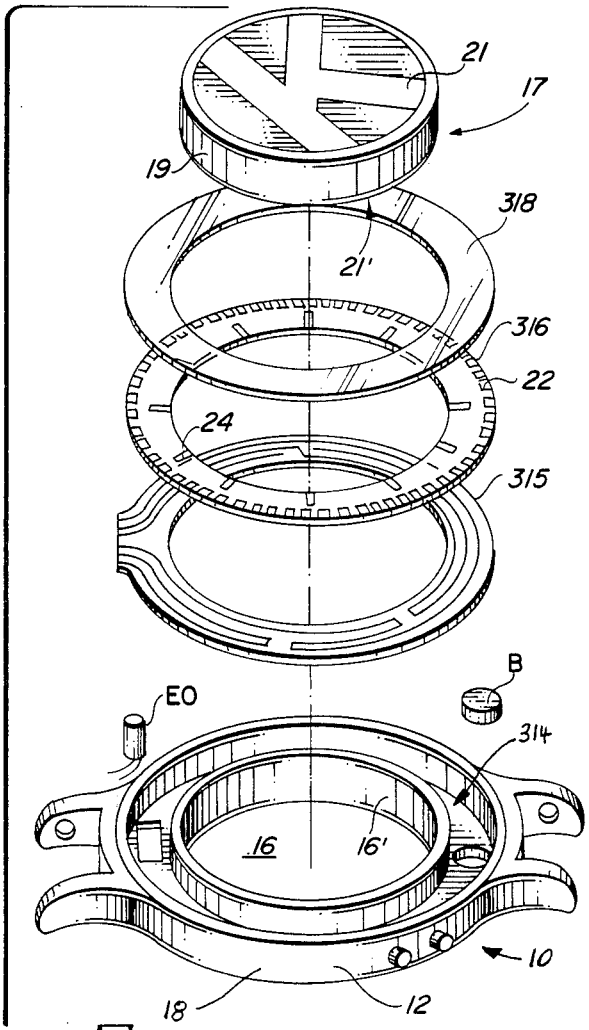
FIG. 5

TIMEPIECE HAVING CENTRAL OPENING

RELATED PATENT APPLICATION

This patent application is a continuation in part of my patent application Ser. No. 337,110; filed Jan. 5, 1982; now U.S. Pat. No. 4,473,304 issued Sept. 25, 1984.

DISCLOSURE DOCUMENT

Reference is made to Disclosure Document No. 126,738 filed Apr. 23, 1984, entitled "TOROIDAL WATCH ADAPTERS", for inventor Eugene Neil Ketner. In accordance with M.P.E.P. 1706, Applicant requests that Disclosure Document No. 126,738 be incorporated into the file wrapper of the above identified patent application, submitted herewith, by the instant reference thereto.

BACKGROUND OF THE INVENTION

This invention is to a timepiece, such as a pocket or wrist watch, of the type worn or carried by individuals. It is known to fabricate time pieces, such as pocket or wrist watches, as a solid, non-apertured body having a variety of peripheral configurations. Insofar as decorations were concerned, prior art designs were generally limited to utilization of jewels or engraving on or around the visible face of the watch.

In contrast to prior art configurations, the watch design of this invention allows an unlimited number of configurations to be utilized for both the periphery and a central opening formed in the body of the watch. Personal identity can now be an integral part of the timepiece. Initials, logos, decorations, and trademarks can be incorporated into the central aperture of the timepiece to provide various different configurations, each of which may appeal to a wide range of purchasers.

The central opening configuration is realized in accordance with the present invention by the provision of a member made complimentary respective to the central opening which admits the member to be received within the central opening. Various configurations of the central member allow unlimited designs to easily be incorporated into the watch.

SUMMARY OF THE INVENTION

A personalized timepiece comprising a body having opposed faces, with there being an aperture formed through the body and the opposed faces. Indicator means related to time keeping is provided on one of said faces, and means are provided within the body by which the indicator means provides data related to the time of day. The aperture provides a central opening within which there is received a member which displays various designs. The central opening configuration is realized in accordance with the present invention by the provision of a member made complimentary respective to the central opening which admits the member to be received within the central opening. Various configurations of the central member allow unlimited designs to easily be incorporated into the watch.

In one embodiment of the invention, one face of the timepiece is made into independently movable concentric discs which are moved relative to one another and to the main body. One of the discs is related to the hours of the day and the other disc is related to the minutes of the hour. The relative movement between the body and the two discs is such that the time of day is always indicated by the relative position of the discs.

The main body of this embodiment is circular in form and includes a relatively large circular aperture formed more or less centrally therethrough. The body is thus generally similar to a toroid. In an alternant embodiment of the invention, the main body is rectangular in configuration and includes a rectangular aperture formed therethrough. In these and other configurations of the opening, the central opening configuration is realized in accordance with the present invention by the provision of a member made complimentary respective to the central opening which admits the member to be received within the central opening. Various configurations of the central member allow unlimited designs to easily be incorporated into the watch.

In another form of the invention, the indicia includes an optically displayed digital time indication.

In another form of the invention, the indicator means is made up of electro-optical devices, such as liquid crystal devices, arranged to present radial bars divided into an inner segment and an outer segment with the segments being illuminated by an electric drive circuit and respectively indicating the hour and minute of the day.

In a preferred embodiment of the invention, sixty electronically illuminated dots or bars are spaced around the central opening to indicate the minutes while a second peripheral array of twelve electronically illuminated dots or bars indicate the hour.

Accordingly, a primary object of the present invention is the provision of a timepiece which is artistic in appearance, irresistibly pleasing to the eye, and includes personalized centrally located design material affixed to a central opening thereof.

Another object of the present invention is the provision of a timepiece made in the form of a body having a central aperture therethrough with a member bearing an artistic design being removably received within the central aperture.

A further object of the present invention is the provision of a timepiece having opposed faces, with there being a common aperture formed through each of the faces to thereby provide a window through the interior of the watch within which a member bearing an artistic design is mounted.

Still another object of the present invention is the provision of a timepiece in the general form of a toroid, with there being indicia applied to one face of the watch and means by which the indicia is related to the time of day, and further including a member of artistic design removably received in mounted relationship within the center of the toroid.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner hereinafter described and illustrated.

BRIEF DESCRIPTION OF THE DRAWINGS

FIG. 1 is a fragmentary, perspective, part disassembled view of a timepiece made in accordance with the present invention attached to a person's wrist;

FIG. 2 is a perspective view showing another watch similar to the watch of FIG. 1, partially disassembled and suspended in space;

FIG. 3 is a top plan view of a timepiece which represents an alternant embodiment of the present invention;

FIG. 4 sets forth another alternant embodiment of the present invention;

FIG. 5 is an exploded, part schematical, perspective view of the embodiment of FIG. 4;

DETAILED DESCRIPTION OF THE PREFERRED EMBODIMENTS

Figure 6:
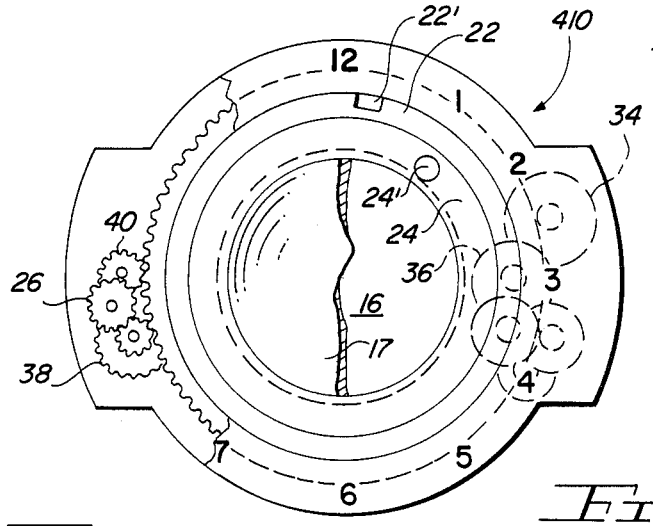
FIG. 6 is an enlarged, top plan view of still another embodiment of the present invention.

In FIG. 1, there is disclosed a timepiece 10, made in accordance with the present invention. The timepiece 10 includes a main body 12 to which there is attached a watch band 14 so that the watch or timepiece can be conveniently supported upon one's wrist 15.

An aperture 16 forms a central opening which extends through the main body of the watch. An insert member, 17, is received within the aperture 16, preferably in close tolerance relationship therewith. The outer surface 18 of the watch is illustrated as circular, and is interrupted by the lugs or ears which accommodate the band 14. The outer face of the watch has indicator means 22 and 24 related to time keeping formed thereon. Specifically, outer face 22 is in the form of a disc and is related to hours. The disc rotates respective to the main body. Inner face 24 is also in the form of a disc and is related to minutes. The discs each rotate independently of one another and respective to the main body. The inner and outer rotating discs are concentric with respect to one another and are connected to a gear train which imparts proper time keeping, as is more fully discussed in my previous patent application Ser. No. 337,110; Filed: Jan. 5, 1982; now U.S. Pat. No. 4,473,304 issued Sept. 25, 1984, of which this patent application is a continuation in part.

In FIG. 2, the toroidal timepiece is shown suspended in space to illustrate the size of the central opening, and it will be noted that distant objects can be viewed through the aperture. The timepiece of FIG. 2 can be made in the form of a pocket watch, if desired, while remaining within the comprehension of this invention. Insert member 17 is received within the central opening or aperture 16.

In the embodiment of FIG. 3, the timepiece 210, for purposes of illustration, is shown in the form of a wrist watch. The outer face 26 of the watch has indicia formed there upon related to time keeping. Indicator means 22, 24 are formed between the outer wall 18 and inner wall 220 of the main body. The indicia at 22 and 24 preferable is in the form set forth in U.S. Pat. No. 3,844,105 to T. Kashio of Tokyo, Japan. An insert member 17 is mounted within the central opening 16.

Kashio teaches that rectangular indicator elements made of liquid crystal substance are arranged at a loop line on a display panel and oriented radially to form an indication section. A second similar section is concentrically mounted inboard of the outer section, and the latter receives minute outputs from digitally driven time counting means to cause the outer section to perform hour indications. Reference is made to the details of this disclosure for further explanation of the operation thereof.

FIG. 4 represents one of the preferred embodiments of this invention. In this figure, the body 310 of the watch 12 is of conventional rectangular circular peripheral configuration but defines a large central aperture 16. Surrounding the central aperture 16 and mounted in the body 310 of the watch 12 is a first peripheral array of twelve electronically energized light emitting dots or bars 24 representing the hour of the day. Surrounding the dots or bars 24 is a second peripheral array of sixty electronically illuminated dots or bars 22 to indicate the minutes. The dots or bars can constitute light emitting diodes (LEDs) or, alternatively, liquid crystal indicators, both of which are well known in electronic art. The central opening 16 receives insert member 17 therein. The insert member 17 has an outer peripheral wall surface made complimentary respective to the wall surface which defines the central opening 16 so that insert member 17 of various design can be selected for insertion into the central opening.

Referring now to the exploded view of FIG. 5, it will be seen that the body 12 of the watch 10 comprises a U-shaped annular section 18 defining an annular channel 314 which is suitably internally contoured to provide a mounting for receiving a generally cylindrical electronic battery B and an electronic oscillator EO. An annular piece of circuit board 315 is also mounted in channel 314 and the electronic light display board 316 carrying light emitters 22 and 24 is mounted in channel 314. The circuitry employed is entirely conventional and well known in the prior art and results in a particular hour and minute light being energized in concentric rings 22 and 24 of light emitting elements corresponding to the exact time of day in hours and minutes. A crystal 318 is, of course, provided to overlie the light emitting elements 22 and 24.

Insert member 17 has a circumferentially extending outer wall surface 19 located between opposed faces 21, 21′ thereof. Various artistic designs, such as the illustrated "K", can be applied to either side 21, 21′ of the member 17. It is considered that any watch embodying this invention and having an enlarged central aperture may be personalized through the insertion of member 17 in the central opening 16. In this particular instance, the initial "K" is affixed to wall members 19 which is inserted in the aperture 16 of a watch 10 and secured therein by any suitable expedient including jeweler's solder or any other conventional means, such as adhesive. Religious or organization symbols, logos, trademarks and similar personalizing indicia may be utilized in place of initials.

In FIG. 6, there is disclosed a timepiece 410 in the form of an oblated doughnut having relatively large circular aperture 16 formed centrally therethrough. A gear train at 34, 36, and 38 drives a pair of rotatable concentric discs 22 and 24. The concentric discs include indicators 22′ and 24′ thereon which indicate the time in minutes and hours by reference to the fixed indicia 1–12 placed about the illustrated fixed portion of the main body.

Figure 7:
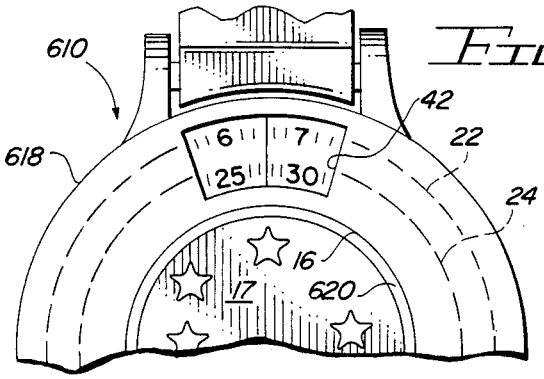
FIG. 7 is a fragmentary, top plan view which is an illustration of still another embodiment of the present invention.
Figure 11:
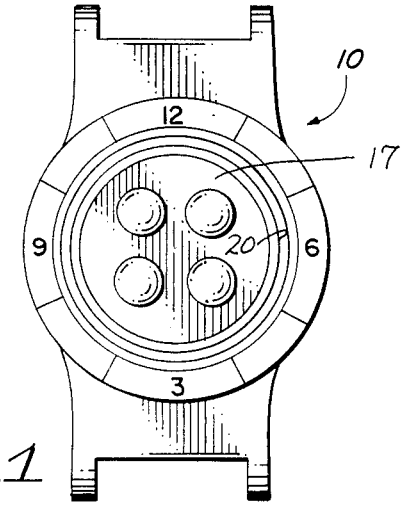
Figure 8:
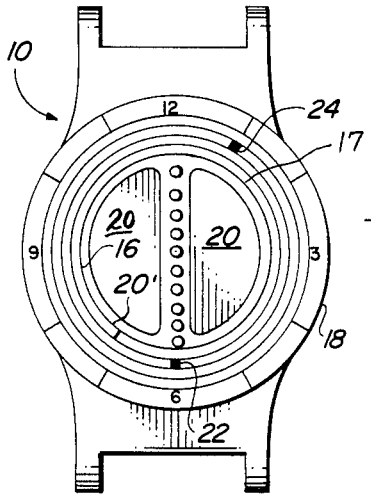
Figure 12:
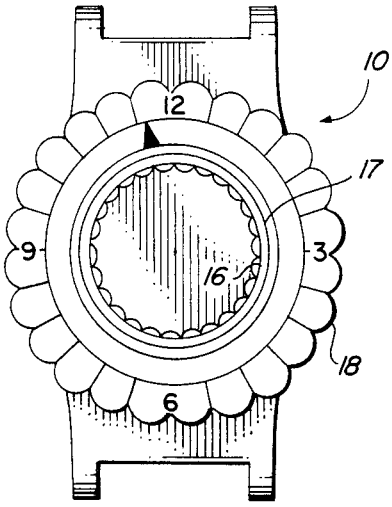
Figure 9:
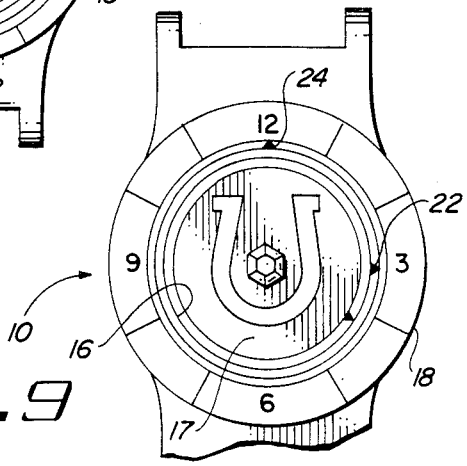
Figure 13:
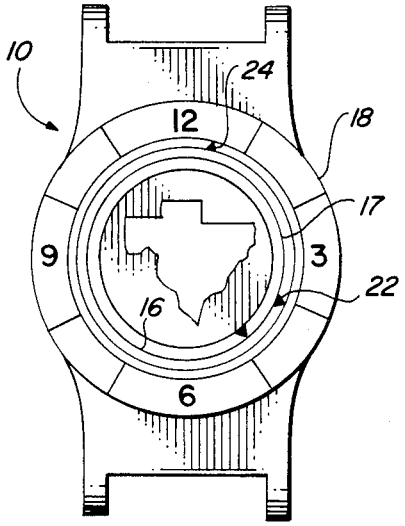

In FIG. 7, there is disclosed a watch 610 having an aperture 16 formed therethrough which has a configuration defined by circumferential extending sidewall 620. Within the annular main body, there is arranged rotatable concentric discs, 22 and 24, similar to the discs of the embodiment of FIG. 5. One window 42 overlies the rotating concentric discs and displays the illustrated numerals related to time keeping.

In FIG. 7, the time is displayed in window 42 by means of two separately independently rotatable coplanner concentric rings 22 and 24. Each ring carries a plurality of magnetic domains and is independently stepped by a set of electro magnets driven by a multiphase train in the manner of U.S. Pat. No. 3,712,046 to which reference is made for the details thereof.

Figure 10:
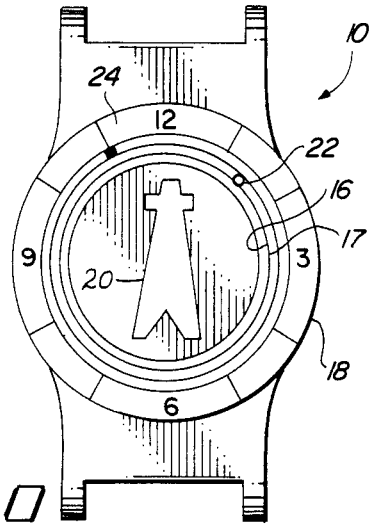
FIGS. 8–13 are top plan views of other embodiments of the present invention.

FIGS. 8–13 show various different configurations of insert members 17 mounted within the opening 16 formed through the body of the timepiece. The timepiece 10 of FIG. 8 includes an insert member 17 having one face thereof in the form of two crescent shaped lands 20 which essentially amount to a raised area having a valley formed across the center thereof. The central hole 16 of FIG. 9 receives an insert 17 having a diamond centered within a horseshoe formed therein. FIG. 10 illustrates the aperture 16 having an insert in the form of an oil well derrick 20 therein. The aperture 16 of FIG. 11 receives an insert 17 in a manner similar to the embodiments of FIGS. 8–10. The insert 17 of FIG. 11 includes four radially spaced circles formed within the outer boundary provided by the circular sidewall 20, seen in FIG. 1.

The apertured timepiece of FIGS. 8–13 may be identical in construction. The insert members of FIGS. 8–13 have an o.d. of a size which enables the insert to be slidably received within central opening 16. The artistic design placed on either opposed face of the insert can take on various different appearances. The insert 17 can be secured within the central opening in a number of different manners, as will be more fully set forth hereinafter.

Figure 14:
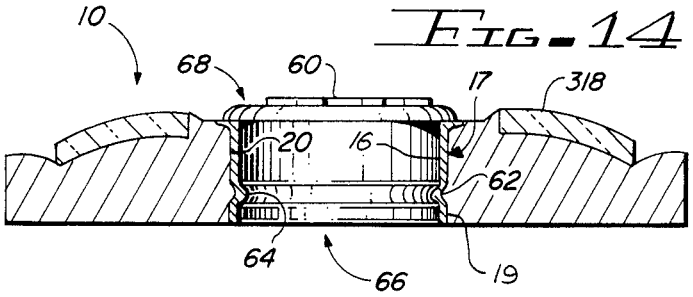
FIG. 14 is a cross-sectional view taken along line 14—14 of FIG. 4.
Figure 15:
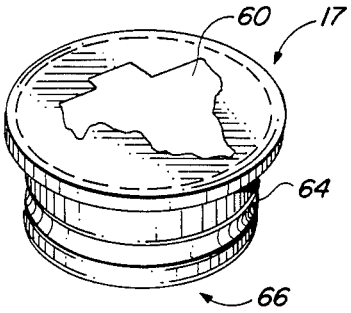
FIG. 15 is a perspective view of part of an apparatus similar to one found in FIG. 14; and, FIG. 16 is a disassembled, perspective view of an apparatus similar to the one disclosed in FIG. 15.
Figure 16:
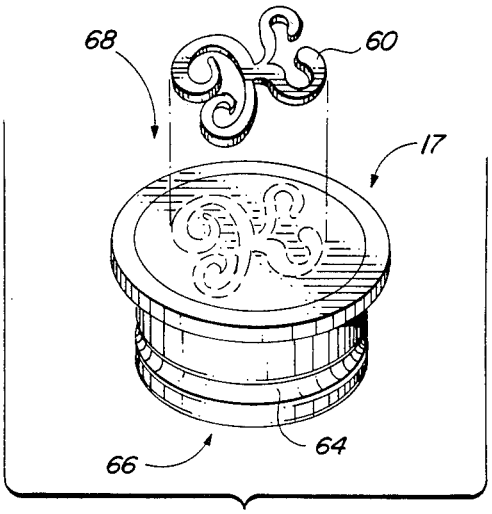

FIGS. 14–16 sets forth additional details of the insert 17 and the configuration of the opening 16. As seen in FIG. 14, a removable insert member 17 is releasably anchored within central opening 16 of watch 10. The interior wall 20 which forms opening 16 is provided with a circumferentially extending outwardly directed ridge 62 which receives a complimentary groove 64 circumferentially extending about the outer wall surface 19 of the insert member. The design 60 can be mounted to either face 68, 66 of the insert member. The design 60 can be attached to face 66, 68 of insert 17 by any desired manner, including cementing, welding, and the like, as is known to those skilled in the art.

The present invention provides a personalized timepiece comprising an annular body having opposed faces, with a central opening being formed through the body which results in each of the opposed faces also being apertured, and each of the faces assume an outer boundary which extends about and defines the geometrical configuration of the faces, and an inner boundary which defines the configuration of the central opening. Indicator means related to time keeping is included near the face. Means forming indicia is provided on one of the faces, with the indicia being related to hours and minutes of the day. Means are housed within the annular body by which the indicator means provides data related to the time of day.

The central opening through the main body which forms the timepiece into a generally annular configuration can take on many different forms, and receives an insert member on which various decorations have been provided.

In the specification, the term "relatively large aperture" or "relative large central opening" is intended to mean a central opening having a mean diameter at least one-fourth of the mean outside diameter of the watch, and preferably a hole which is one-half the mean diameter of the watch. When the outside diameter and the inside diameter of the watch are both unduly increased, the watch favors the form of a bracelet rather than a wrist watch and this type of toroidal timepiece is also included in the intellectual property deemed to be embraced by Applicant's claims. On the other hand, when the central opening is unduly reduced in diameter, a configuration is ultimately reached wherein the timepiece no longer resembles a doughnut, or toroid, and such a small aperture is not deemed to be embraced by the term "relatively large aperture".

The insert member 17 can be permanently or removably mounted within the central opening 16. A number of different designed insert members 17 may be desired for a single timepiece thereby enabling a different selection of an insert member for each day of the week, for example.

The present invention provides a toroidal or doughnut shaped watch having a main body through which a central opening is formed. The opposed artistically different faces of the main body can be made with designed time keeping means thereon so that when the watch is inverted, or reversed, an artistic design is displayed which is different in appearance from the other side of the watch. The central opening, through the main body, receives an insert member. The insert has opposed faces. A different artistic design can be placed on each opposed face of the insert member. The insert member can be made removable respective to the central opening. Hence, the opposed faces of the main body in combination with the opposed faces of the insert admit four different combinations of design material to be selectively displayed by the wearer of the watch.

I claim:

1. A timepiece comprising a body having opposed faces, a central opening formed through said body which results in each of said opposed faces assuming an inner boundary which extends about and defines the configuration of said opening and an outer boundary which defines the configuration of the peripheral edge of said body; indicator means on one of said faces related to time keeping; means housed within said body by which said indicator means provides data related to the time of day, and an insert member having an outer wall surface made into a configuration which enables said insert member to be mounted within the opening.

2. The timepiece of claim 1 wherein said indicator means includes indicia related to the minutes and hours of the day; and further including means associated with said indicia for indicating the time of day; said insert member including means by which it is removably received within the opening.

3. The timepiece of claim 2 wherein said indicator means includes two spaced, co-axial members freely movable respective to one another with one of said co-axial members being related to minutes and the other of said co-axial members being related to hours; and, means for imparting relative movement to said co-axial members; said insert member includes at least one face, means forming an artistic design on said at least one face.

4. The timepiece of claim 1 wherein said insert member includes opposed faces described by said outer wall surface, one of the last said opposed faces includes means forming an artistic design thereon.

5. The timepiece of claim 4 and further comprising means by which said insert member is removably received within the central opening.

6. The timepiece of claim 1 and further comprising opposed faces formed within said outer wall surface, means forming a personalized insignia mounted on one of the said opposed faces.

7. The timepiece of claim 1 wherein the central opening formed through said body defines a cylindrical surface which results in said body assuming an annular configuration, and further including opposed faces formed within said outer wall surface, means forming a personalized insignia mounted on one of the last said opposed faces.

8. The timepiece of claim 7 wherein said body is cylindrical in form; said indicator means includes indicia related to the minutes and hours of the day; and further including means associated with said indicia for indicating the time of day.

9. The timepiece of claim 8 wherein said indicator means includes two spaced, co-axial members freely movable respective to one another with one of said co-axial members being related to minutes and the other of said co-axial members being related to hours; and means for imparting relative movement into said co-axial members.

10. The timepiece of claim 7 wherein said indicator means is concentric circles of electrochromic display means electrically connected to an electric current flow means to cause said display means to change color in a continually advancing manner as a function of the said current flow so as to indicate accumulated electric current flow.

11. The timepiece of claim 10 wherein said concentric circles of electrochromic display means comprises a plurality of radially positioned spaced elements arranged to indicate elapsed time.

12. A toroidal timepiece comprising a body having opposed faces, means forming an aperture through each of said opposed faces to thereby provide a window through the timepiece, said aperture results in each of said opposed faces assuming a boundary which extends about and defines the configuration of said window and the configuration of said opposed faces determines the configuration of the peripheral edge of said body;

said window has a mean diameter which is at least one-fourth the mean overall diameter of the main body;

indicator means on one of said faces related to time keeping, means housed within the interior of said body by which said indicator means provides data related to the time of day; an insert member having an outer edge made into a configuration which enables said insert member to be mounted respective to the aperture.

13. The timepiece of claim 12 wherein said window is a cylindrical surface which results in said body assuming an annular configuration, and further including lugs formed on said body by which the timepiece can be attached to one's wrist.

14. A timepiece comprising a main body having opposed faces; means forming indicia on one of said opposed faces; said indicia is related to time keeping;

indicator means associated with said indicia for indicating the time of day;

a passageway extending through said main body, said passageway has an inner wall surface which defines a window, said passageway extends through each of said opposed faces, thereby causing said main body to assume the form of a toroid, said window has a mean inside diameter which is at least 25% of the mean outside diameter of said main body; means contained within the main body for actuating said indicator means and thereby providing the time of day;

an insert member having an outer edge made into a configuration which enables said insert member to be supported in mounted relationship respective to the inner wall surface of said passageway.

* * * * *